United States Patent [19]

Brown

[11] 4,426,815

[45] Jan. 24, 1984

[54] MORTARLESS CONCRETE BLOCK SYSTEM HAVING REINFORCING BOND BEAM COURSES

[76] Inventor: Sam Brown, 7564 Wellington Way, Clayton, Mo. 63105

[21] Appl. No.: 205,234

[22] Filed: Nov. 10, 1980

Related U.S. Application Data

[63] Continuation of Ser. No. 101,484, Dec. 10, 1979, abandoned, which is a continuation-in-part of Ser. No. 912,520, Jun. 5, 1978, abandoned.

[51] Int. Cl.[3] ..... E04B 1/00

[52] U.S. Cl. ..... 52/100; 52/284; 52/593; 52/437; 52/605

[58] Field of Search ..... 52/438, 439, 100, 591, 52/593, 605, 606, 284, 286, 259, 589, 437, 424, 98, 605, 606

[56] References Cited

U.S. PATENT DOCUMENTS

| | | | |
|---|---|---|---|
| 811,534 | 2/1906 | Akers et al. | 52/286 |
| 989,677 | 4/1910 | Wiederholdt | 52/593 |
| 1,365,162 | 1/1921 | Ferguson | 52/591 |
| 1,656,197 | 1/1928 | Henderson | 52/259 |
| 1,836,408 | 12/1931 | Sutton | 52/589 |
| 2,320,690 | 6/1943 | Willis | 52/438 |
| 2,452,463 | 10/1948 | Herbert | 52/593 |
| 2,482,719 | 9/1949 | Rigaumont | 52/589 |
| 2,881,614 | 4/1959 | Preininger | 52/438 |
| 2,951,318 | 9/1960 | Sedlak | 52/100 |
| 3,187,465 | 6/1965 | Giuliano | 52/505 |
| 3,256,657 | 6/1966 | Phipps | 52/227 |
| 3,422,588 | 1/1969 | Stewart | 52/285 |
| 3,962,842 | 6/1976 | Wilhelm | 52/436 |
| 3,968,615 | 7/1976 | Ivany | 52/439 |
| 4,010,581 | 3/1977 | Keturi et al. | 52/259 |

FOREIGN PATENT DOCUMENTS

| | | | |
|---|---|---|---|
| 133809 | 8/1949 | Australia | 52/591 |
| 2200015 | 8/1913 | Fed. Rep. of Germany | 52/606 |
| 839408 | 5/1952 | Fed. Rep. of Germany | 52/284 |
| 546143 | 8/1922 | France | 52/100 |
| 1016977 | 9/1952 | France | 52/439 |
| 1024717 | 1/1953 | France | 52/284 |
| 1093587 | 12/1954 | France | 52/100 |
| 1146501 | 5/1957 | France | 52/437 |
| 1387356 | 12/1964 | France | 52/606 |
| 2346514 | 10/1977 | France | 52/606 |
| 500491 | 11/1954 | Italy | 52/424 |
| 21559 | of 1900 | United Kingdom | 52/589 |
| 166623 | 7/1921 | United Kingdom | 52/593 |
| 223820 | 10/1924 | United Kingdom | 52/594 |
| 551529 | 2/1943 | United Kingdom | 52/284 |
| 953739 | 2/1964 | United Kingdom | 52/439 |

OTHER PUBLICATIONS

French Addition 65,306, 1st Addition of French 1,062,994, 10-1955, 1 SD, 2 pages spec.

Civil Engineering Publication, Jul. 1942, p. 395.

*Primary Examiner*—James L. Ridgill, Jr.

*Attorney, Agent, or Firm*—Rogers, Eilers & Howell

[57] ABSTRACT

In a mortarless interlocking concrete block system, general purpose intersection blocks have parallel grooves formed on their bottom surfaces; but each has mating ridges on the upper surface of its inner end only. The top surface of its corner end portion is flat, to permit an overlying course to fit thereon either at right angles or in linear alignment. The corner end portion has, in each of its two opposite side faces and in its outer end face, parallel vertical grooves matable with tongues on the system's stretcher blocks, to provide interengagement at both left and right corners and T-shaped and crossing-wall intersections. For bond beam courses, a bond beam intersection block with similarly grooved corner end faces, has at its inner end portion a closed-bottom channel with saddle-like webs extending between the channel sides, to open through to its corner core and support horizontal reinforcing rods. Consistently formed bond beam blocks are provided, whose tongues may engage any of the grooved corner end faces at wall corners and intersections. Breakout provisions in the corner core inward of these faces make it simple, at any intersection, to lead horizontal reinforcing rods to the cored corner end portions, through which vertical rodding and grouting is provided. By utilizing horizontal reinforcing rods formed at a right angle to extend through the corner block between its two adjacent blocks, the two perpendicular walls may be more securely tied together, to prevent vertical cracking. This furnishes to the easily-constructed mortarless wall block system a sturdy, reinforced concrete grid.

Where desired, blocks made of other material, for example, redwood, may be utilized; also in miniature, the invention may be incorporated in sets of toy blocks, which have exceptional educational value.

19 Claims, 13 Drawing Figures

94
95
96
101
91
99
116
90
115
117
110
121
92
114
113
112
111
8

91
95
96
99
90
120
110
121
112
94
93
116
101
100
97
98
118
111

10
41
40
30
a
51
43
17
59
58
56
61
57

10
12
59
52
51
40
17
45
42

MORTARLESS CONCRETE BLOCK SYSTEM HAVING REINFORCING BOND BEAM COURSES

RELATED APPLICATIONS

This application is a continuation of application Ser. No. 101,484, filed December 10, 1979, which is a continuation-in-part of Ser. No. 912,520, filed June 5, 1978, both abandoned.

BACKGROUND OF THE INVENTION

1. Field of the Invention

The present invention relates to molded concrete blocks for masonry construction, and specifically to mortarless interlocking blocks for such use.

2. Prior Art

In the prior art, concrete blocks have been molded with tongue and groove interlocking provisions in their top and bottom surfaces and end surfaces for mortared block systems, as shown in U.S. Pat. No. 3,256,657 to Phipps, U.S. Pat. No. 811,534 to Akers, et al., U.S. Pat. No. 2,482,719 to Rigaumont, and U.S. Pat. No. 2,452,463 to Herbert, as well as for mortarless block systems, as shown in U.S. Pat. No. 3,962,842 to Wilhelm, and British Pat. No. 166,623 to Christmas.

Each of the above-named patents discloses special corner blocks for its specific interlocking system; West German Pat. No. 2,200,015 to Bender discloses special corner blocks, but is without interlocking features on the upper and lower block surfaces and does not provide for reinforcing rods.

No known prior mortarless block construction system provides secure T-intersections and crossing-wall intersections.

Bond beam courses are made up of channel-like blocks which receive steel reinforcing rods and grouting to form a horizontal beam to strengthen the structure, as in French Pat. No. 2,346,514 to Bastianelli. French Pat. No. 546,143 to Vaux discloses an interlocking concrete block having end webs which may be broken away to receive horizontal reinforcing rods. Similarly, U.S. Pat. No. 989,677 to Wiederholdt shows break-away end webs in a building tile to be secured to adjacent tiles by interior grouting only. No prior block construction provides for reinforcing the corners of bond beam courses except by extensive on-site modification.

SUMMARY OF THE INVENTION

An object of the present invention is to provide a mortarless system of interlocking molded concrete blocks in which only a minimum number of blocks need be manufactured, and more specifically, to provide such a system having a general purpose corner or intersection block which may be utilized for both right and left corners, partition walls, pilasters and crossing-walls. A second object is to provide such a mortarless interlocking block system without blocks having projections extending outward from the block side faces, whereby to permit efficient use of standard molding apparatus. Another object is to provide a similar bond beam intersection block which may be utilized for both right and left corners and for partition walls, to receive horizontal reinforcement which extends through the corner. Still another object is to provide channel bond beam blocks in which the steel reinforcing rods may be supported, previously to grouting, above the channel bottom.

Other objects will be apparent from the disclosure which follows.

For constructing right and left corners, and T-shaped and crossing-wall intersections, the system has general purpose intersection blocks, each comprised of two portions. Its inner end portion is somewhat conventional, with a pair of parallel mating grooves formed in its inner end face and a pair of parallel mating ridges formed on its upper surface, as well as a pair of parallel mating grooves formed into its lower surface. However, its corner end portion outer end face and two opposite side faces each have a pair of parallel vertical mating grooves, which will receive the parallel vertical tongues of stretcher blocks, while its corner end portion top surface is without ridges, thereby accommodating the bottom surface of a corner end portion of a similar intersection block of the next upper course positioned thereon at right angles thereto or in linear alignment therewith.

For bond beam courses, which are horizontally rodded and grouted by utilizing channel-shaped bond beam blocks, the system has a corresponding bond beam intersection block whose inner end portion has a channel hollow extending from its inner end face, which is vertically grooved, into its corner end portion, which has a hollow vertical core continuing from the inner end channel hollow. The interior of the corner end portion is vertically grooved similar to the general purpose intersection block. The vertical core has a plurality of breakout provisions for opening its side and end faces. The continuous horizontal rodding and grouting so afforded through bond beam courses and vertical grouting through said vertical cores provide a strong interlocking grid. Reinforcing rods having right angle bends within the corner end portion of the corner block and extending horizontally into both adjacent blocks may be used to tie the two walls, preventing cracking. Likewise, right-angle reinforcing rods may be installed in a vertical plane extending from a bond beam course upward or downward through a grouted vertical core adjacent to a window or door, or at a wall intersection.

DESCRIPTION OF THE PREFERRED EMBODIMENT

Figure 1:
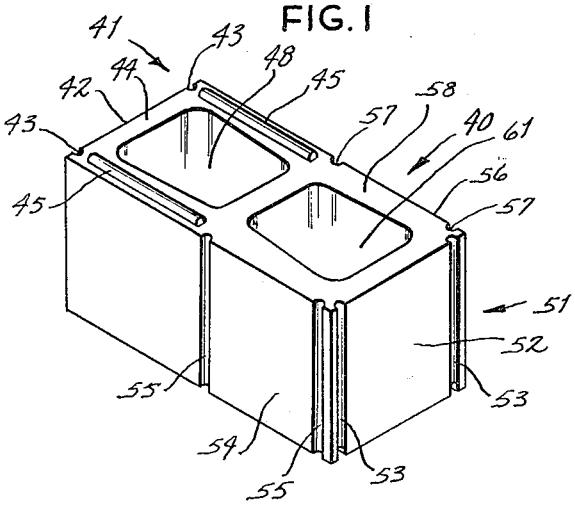
FIG. 1 is an isometric view of a general purpose intersection block embodying the present invention, shown from above and from its outer or corner end.

The present invention comprises a mortarless system of interlocking molded concrete rectangular blocks of an established depth, including numerous blocks of varying shapes and lengths, each for different purposes. Typically, the blocks are 8" high, 16" long and nominally 8" wide (actually slightly less). Sure block is referred to, both in the trade and in this specification, as an 8" block and is the type shown in the drawings. Blocks of similar heighth and length, but of 12" width, are referred to as 12" blocks. The present system is described herein with reference to 8" blocks, but those of other widths may be used, with slight modifications which will be apparent.

The most extraordinary results of the present invention follow from the features of construction of the blocks used at intersections, at corners and at intermediate partition walls, of both the unreinforced courses and the reinforced courses known as bond beam courses. The intersection blocks so used will be described after describing the other blocks used in such courses.

Full-length stretcher blocks

Figure 3:
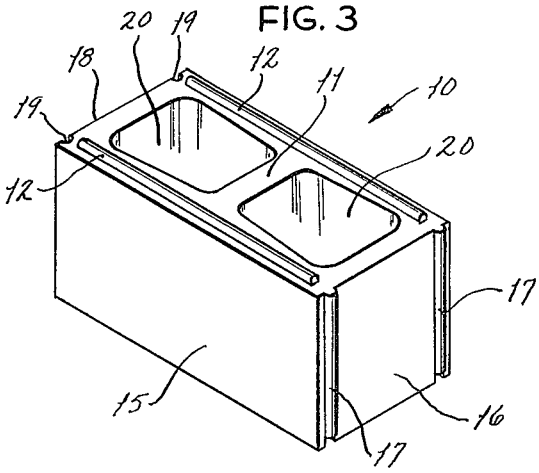
FIG. 3 is an isometric view of a stretcher block, for use with the general purpose intersection block of FIG. 1, shown from above.
Figure 4:
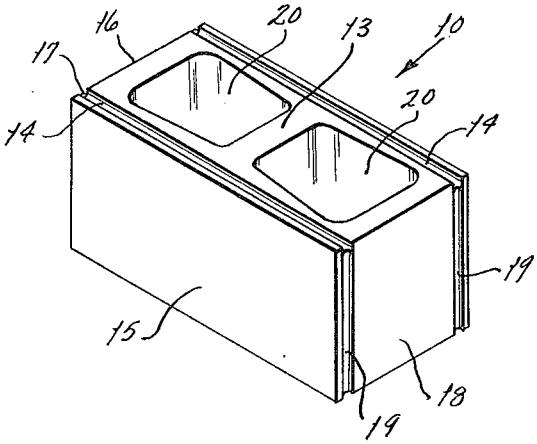
FIG. 4 is a bottom isometric view of the stretcher block of FIG. 3.

The most often used blocks in the system are full-length stretcher blocks, shown in FIGS. 3 and 4 and generally designated 10, which are positioned atop and overlapping one another to form the wall between corners. They have a generally flat upper surface 11 on which are formed a pair of parallel horizontal ridges 12, one near each edge of the block's long sides. In the embodiment shown, the ridge is three-fourths inch in width and three-eighths inch in heighth, and is spaced three-eighths inch from the block edge. The ridges 12 are shown ending spaced from the block end face, but it may be preferable in many circumstances to provide them extending to the end face, especially where a good vapor barrier is required. The full-length stretcher block 10 has a lower surface 13 in which are formed a pair of parallel horizontal grooves 14 at the same spacing as for the upper surface horizontal ridges 12, hereinafter referred to as the ridge spacing, and matable therewith when one block 10 is positioned atop a second block 10 with their side faces 15, which are flat, in alignment.

The stretcher blocks 10 have a first end 16 on which are formed a pair of parallel vertical tongues 17, here shown at approximately the same spacing as the upper surface ridges 12, but hereinafter referred to as the tongue spacing. The opposite or second end 18 of the stretcher block 10 has a pair of parallel vertical grooves 19 at the above-described tongue spacing, thus being matable with the first end vertical tongues 17. Each stretcher block 10 has a pair of four-sided vertical cores or hollows 20 extending between its upper surface 11 and lower surface 13, one located at each end of the block 10.

Reversal stretcher blocks

For masons to reverse the full-length stretcher blocks 10 so that their first tongued ends 16 are oriented in the opposite direction than other blocks in the same course, the system is provided with reversal stretcher blocks, not shown, which are similar to the full-length stretcher blocks 10. The reversal stretcher blocks differ only in that their second ends have, instead of grooves, a second pair of parallel vertical tongues identical to the tongues on their first ends.

Shortened stretcher blocks

Figure 9:
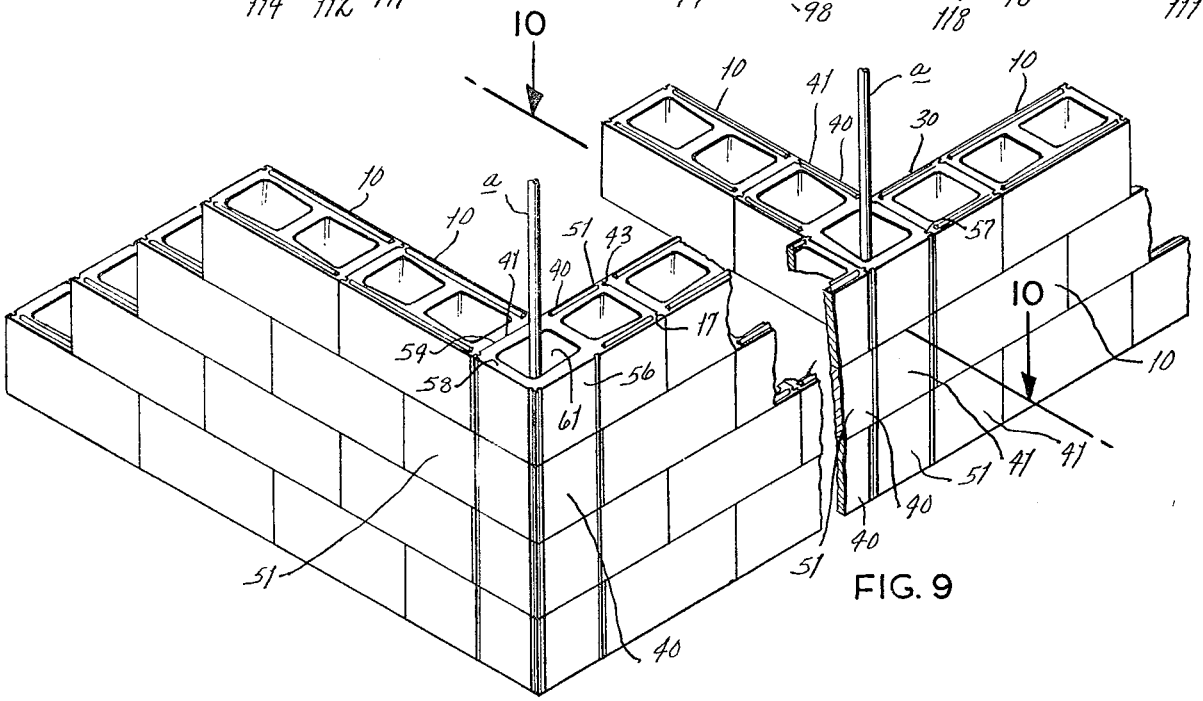
FIG. 9 is an isometric view of a plurality of courses of blocks embodying the present invention, showing the intersections of a forward wall with a left wall and a partition wall. A half-length block is shown to the right of the partition wall in the course there uppermost.

The mortarless block system also has blocks shorter than the full-length stretcher blocks, in the embodiment shown, being a half-length block or half-block 30, shown in FIG. 9 in the forward wall third course at the right side of the partition wall. The conformation of the ends and the upper and lower surfaces of the half block 30 are identical to the full-length stretcher blocks 10. For block systems of other widths, such as 12", the length of the shortened stretcher blocks would be substantially equal to the difference between the length and width of the stretcher blocks 10.

General purpose intersection blocks

In the mortarless block system, the stretcher blocks 10 are not adapted to fit atop one another at right angles as in forming corners or at intersections with partition walls. To serve these functions, the present system provides general purpose intersection blocks, generally designated 40 and shown in FIGS. 1 and 2, of substantially the same exterior dimensions as the full-length stretcher blocks 10. These intersection blocks have corner end portions so different from their inner portions as to require separate description.

The general purpose intersection blocks 40 each have an inner end portion, generally designated 41; this portion 41 has an inner end face 42 with a pair of parallel vertical grooves 43 at the tongue spacing, like the second end 18 of the full-length stretcher blocks 10. The inner end portion upper surface 44 has a lengthwise pair of parallel horizontal ridges 45 while the lower surface 46 has a pair of parallel horizontal grooves 47, both pairs being at the ridge spacing, as in the full-length stretcher blocks 10. The inner end portion 41 has a four-sided hollow vertical core 48 which extends from its upper surface 44 to its lower surface 46 in substantially similar position to the stretcher block vertical core 19.

The corner end portion 51 of each intersection block 40 has an outer end face 52 with a pair of parallel vertical grooves 53 formed at the tongue spacing. It further has a first side face 54 with a pair of vertical parallel grooves 55 at the tongue spacing and a second opposite side face 56 having an identical pair of vertical parallel grooves 57 at the tongue spacing. Its upper surface 58 continues linearly from the inner end portion upper surface 43, but is without ridges. Its lower surface 59 similarly continues from the inner end portion lower surface 45; and the grooves 47 of the inner end portion 41 continue therealong to the outer end face 52. The corner end portion 51 has a similar vertical core or hollow 61 extending from the upper surface 58 to the lower surface 59.

Bond beam channel blocks

Intermediate of horizontal courses comprised of stretcher blocks 10 and general purpose intersection blocks 40, and at the tops of walls, the system utilizes bond beam courses, which are concrete blocks adapted to contain horizontal reinforcing rods b surrounded by grout, placed in position after the blocks have been laid.

Figure 5:
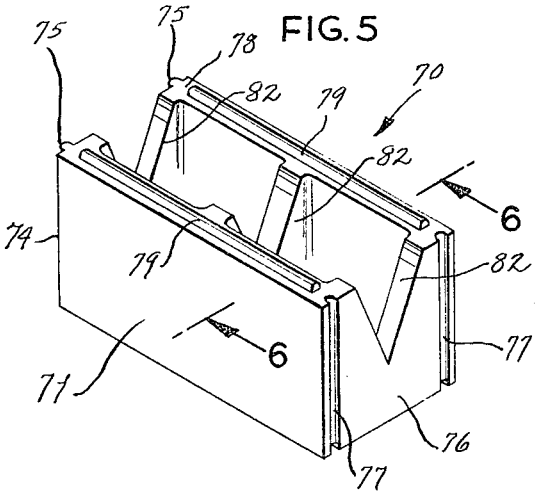
FIG. 5 is a top isometric view of a channel bond beam block having saddle-like webs to support a reinforcing rod.
Figure 6:
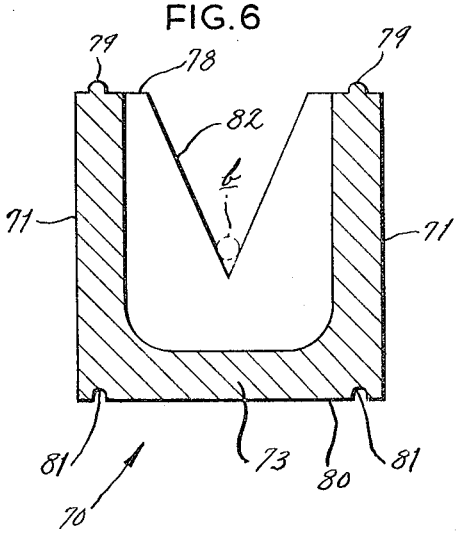
FIG. 6 is a sectional view taken along line 6—6 of FIG. 5.

To comprise the major portion of the bond beam courses, between corners and other wall intersections, the system has bond beam channel blocks, generally designated 70 and shown in FIGS. 5 and 6, which are substantially equal in length to the full-length stretcher blocks 10, and are generally channel-like in structure. The channel blocks 70 each have a pair of vertical sides or side walls 71 which extend upward from a U-shaped solid channel bottom 73 forming, with the side walls 71, a channel. The first end 74 of each channel block 70 has a pair of parallel vertical tongues 75 at the tongue spacing, identical to the full-length stretcher block first end 16. The opposite or second end 76 has a pair of parallel vertical grooves 77 at the same tongue spacing. The channel block upper surface 78 has a pair of parallel horizontal ridges at the ridge spacing, as in the full-length stretcher block upper surface 11; one ridge will be at the top of each side wall 71. The channel block lower surface 80 has a pair of parallel horizontal grooves 81 at the ridge spacing, identical to the full-length stretcher block lower surface 13.

At the first end 74, the second end 76, and spaced halfway therebetween, the channel block 70 has V-shaped saddle-like webs 82 projecting upward from the channel bottom 73 and extending between the side walls 71. These serve both to reinforce the channels and to support horizontal reinforcing rods b above the channel bottom 73 and below the upper surface of the block 70, as shown in FIG. 6. Alternatively, as in FIG. 13, the saddle-like webs 82 may be U-shaped, the saddles having a somewhat flat bottom, for use with the alternative bond beam intersection block of FIG. 12, described below.

Bond beam intersection blocks

Figure 7:
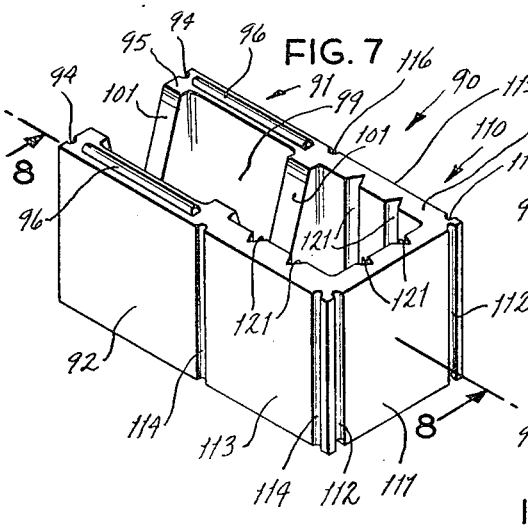
FIG. 7 is an isometric view of a bond beam intersection block embodying the present invention, taken from above and from its outer or corner end.
Figure 8:
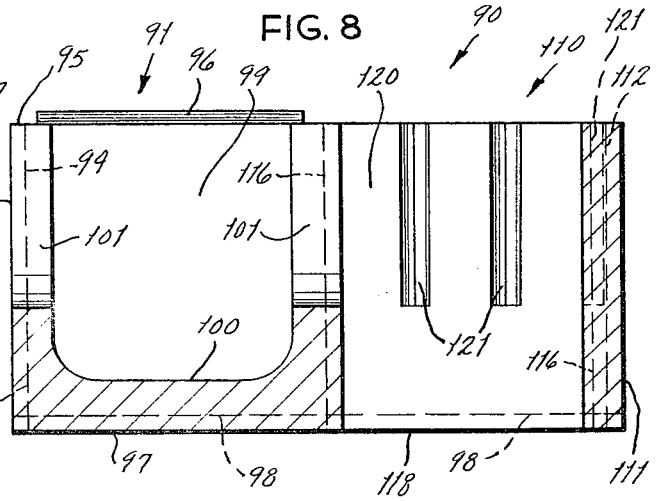
FIG. 8 is a longitudinal sectional view taken along line 8—8 of FIG. 7.

To connect corners and partition walls in bond beam courses utilizing the bond beam channel blocks 70, the system has bond beam intersection blocks, generally designated 90, which are of the same established depth as the full-length stretcher blocks 10. The bond beam intersection blocks 90, like the general purpose intersection blocks 40, are best described as being made up of two portions, an inner end portion and a corner end portion, as shown in FIGS. 7 and 8.

Figure 11:
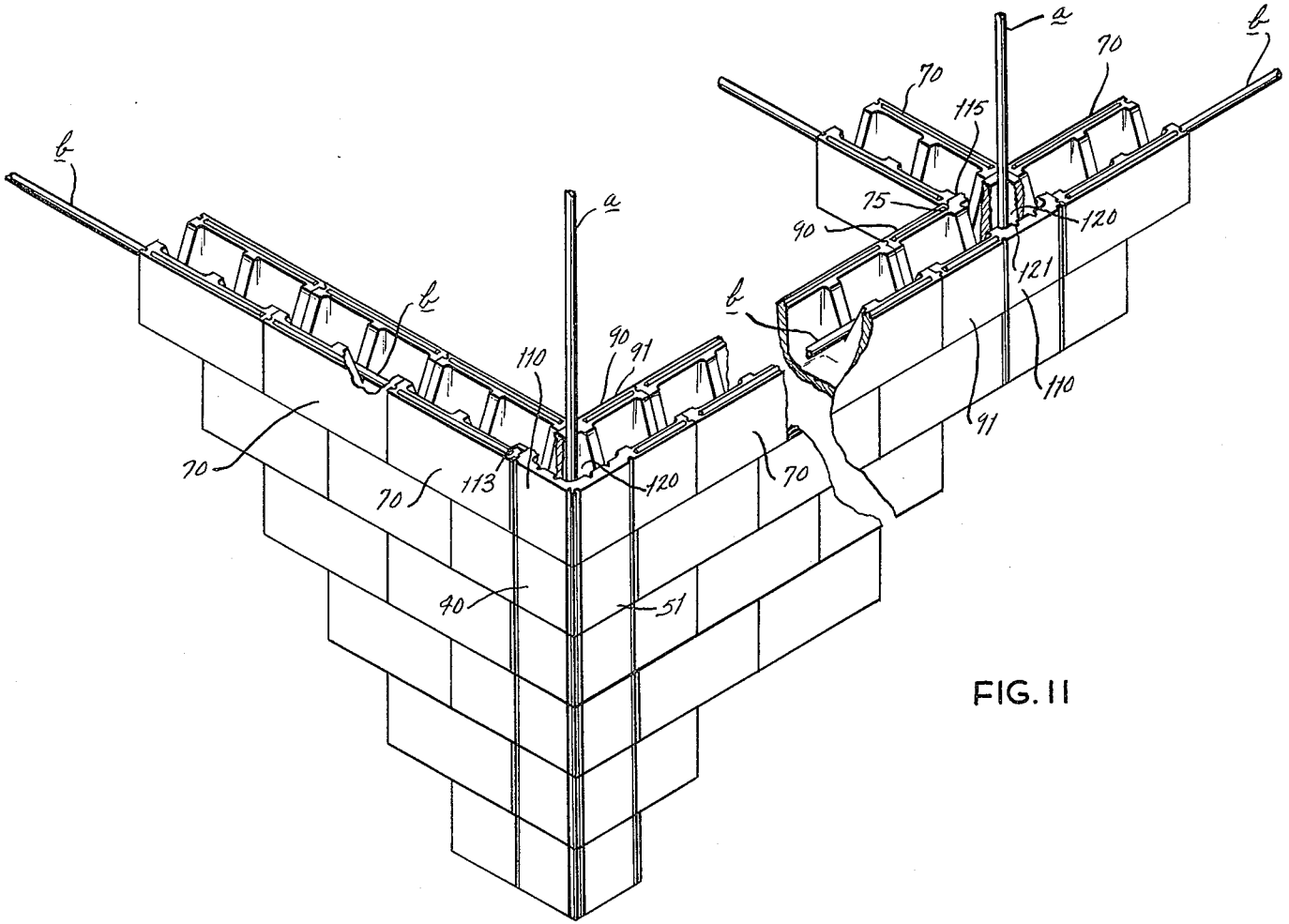
FIG. 11 is an isometric view of a wall system embodying the present invention, a bond beam course with reinforcing rods in place, prior to grouting.

The inner end portion, generally designated 91, has vertical side walls 92 ending outwardly in an inner end face 93 which has formed therein a pair of parallel vertical grooves 94, spaced at the tongue spacing. The side walls 92 extend from an upper surface 95, which has formed thereon a pair of parallel horizontal ridges at the ridge spacing, to a lower surface 97 having formed therein a pair of parallel vertical grooves 98 at the same ridge spacing. Uniquely, the inner end portion 91 has a horizontal channel hollow 99 extending inward through the inner end face 93 and ending downwardly in a solid channel bottom 100. Both its inner end face 93 and at its opposite end, (which corresponds to an intermediate web and leads to the corner end portion described below) the inner end portion 91 has a V-shaped saddle-like webs 101 similar to the channel block saddle-like webs 82, extending between the side walls 92 and projecting above the channel bottom 100, the saddle being of such depth as to support rodding above the level of the channel bottom 100 and below the upper surface of the inner end portion 91, as shown in FIGS. 8 and 11.

The corner end portion, generally designated 110, has an outer end face 111 with a pair of parallel vertical grooves 112 formed therein at the tongue spacing, a first opposite side face 113 with a pair of parallel vertical grooves 114 formed therein at the tongue spacing, and a second opposite side face 115, again with parallel vertical grooves 116 at the tongue spacing.

The corner end upper surface 117 continues linearly from the inner end portion upper surface 95, but unlike the inner end portion, is without ridges. The corner end portion lower surface 118 similarly continues from the inner end portion lower surface 97, whose parallel horizontal grooves 98 continue through this portion. Extending between the upper and lower surfaces 117, 118 is a four-sided vertical core or hollow 120 to which the horizontal channel hollow 99 in the inner end portion 91 extends. The vertical core 120 has pairs of parallel vertical breakout score lines 121 extending toward the first opposite side face 113, second opposite side face 115 and the outer end face 111 downward from the corner end portion upper surface 117 ending upward of the corner end portion lower surface 118, as shown in FIG. 8.

Figure 12:
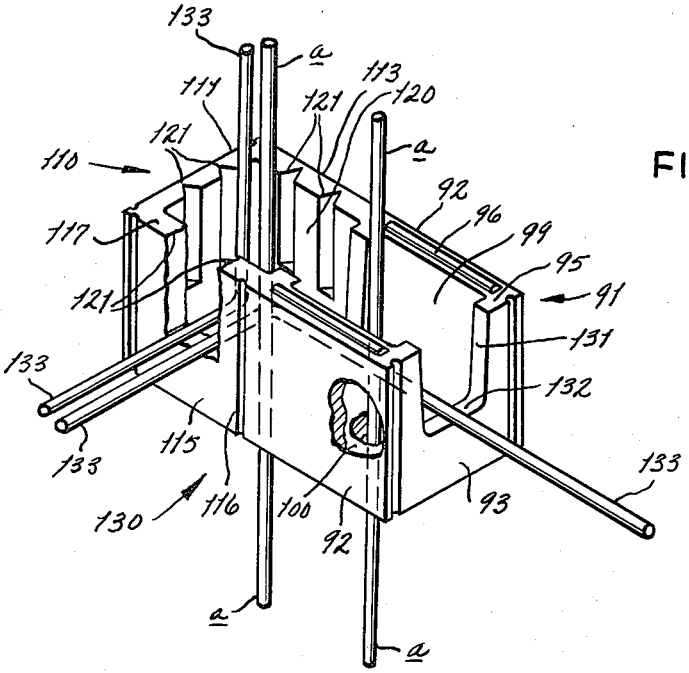
FIG. 12 is an isometric view of an alternative bond beam intersection block, shown receiving right angle reinforcing rods and vertical rodding in its corner end; a side face of the block inner end is partially broken away to show the bottom knocked out to receive a second vertical rod in the cores adjacent to the corner core.
Figure 13:
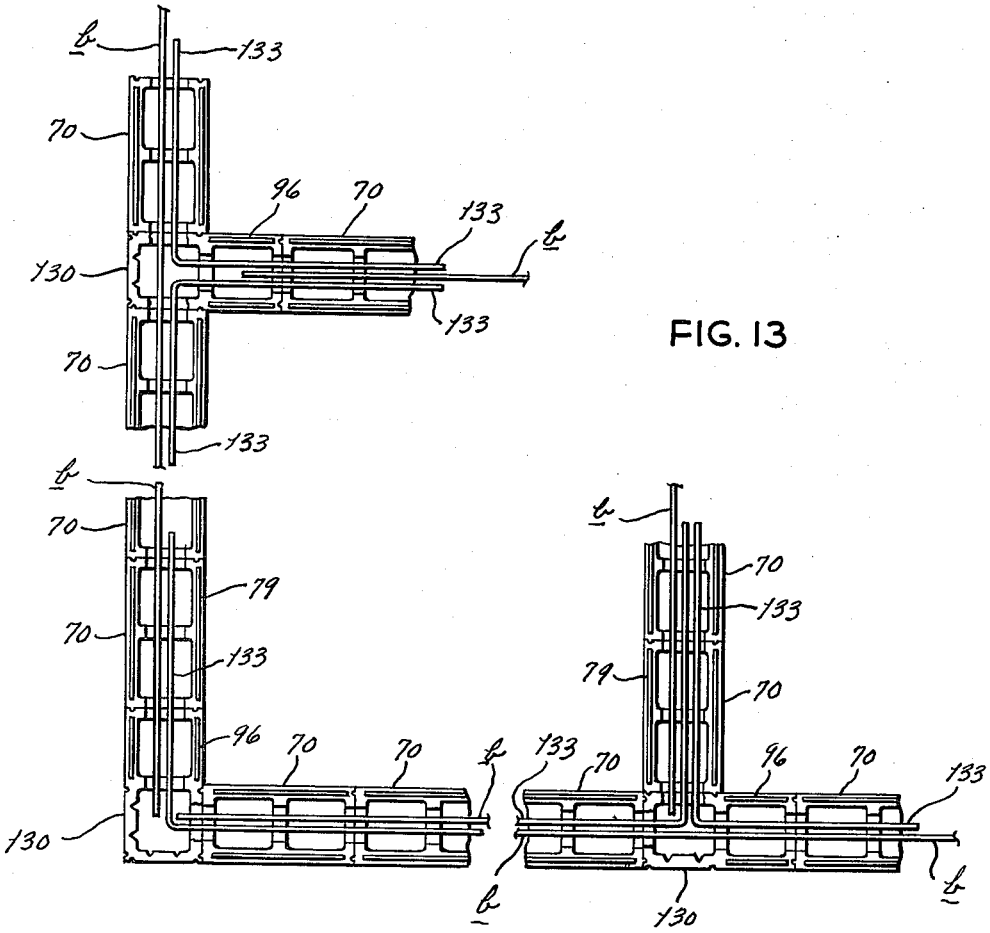
FIG. 13 is a plan view of a reinforced bond beam course utilizing the intersection block and right angle reinforcing rods of FIG. 12.

An alternative bond beam intersection block, generally designated 130, is shown in FIGS. 12 and 13. It is similar to the above-described bond beam intersection block of FIGS. 7 and 8, and its features are similarly designated, except that the inner end face 93 and the intermediate web instead have U-shaped saddles 131 which have a somewhat flat bottom 132. FIG. 12 shows the block 130 accommodating reinforcing rods 113 each having an intermediate right angle bend and two rectilinear elongated portions extending therefrom. One such reinforcing rod 133 is shown in a horizontal plane for connecting two bond beam channel blocks in the same course at the adjacent ends of two perpendicular walls; another is shown in a vertical plane for connecting a bond beam channel course to the aligned grouted cores of general purpose intersection blocks 40 at wall intersections, or to stretcher blocks 10 adjacent to windows and doors.

Manufacture of the present invention

Each of the above-described blocks, being substantially 8" in width, may be manufactured in modified standard molds which accommodate three such 8" blocks side by side. Other standard molding equipment is utilized, typically having movable pallets on which blocks are formed by hydraulic manipulation of mold parts.

Constructing walls with the present invention

Figure 2:
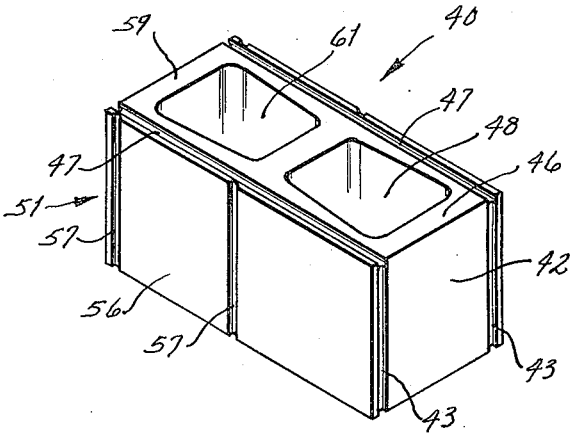
FIG. 2 is an isometric view of the general purpose intersection block of FIG. 1 shown inverted and from its inner end.

Construction of running-wall portions utilizing the stretcher blocks of the present invention is substantially similar to the construction of other mortarless block walls. The primary differences lie in intersections, as at corner, partition walls and crossing-walls, as well as at the bond beam courses. In forming each intersection at which a forward wall meets another wall at right angles, as shown in FIG. 9, in courses made up by stretcher blocks, a general purpose intersection block 40, as shown in FIG. 1, is utilized.

Since the corner end upper surfaces 58 of the general purpose intersection blocks 40 are flat and unridged, onto each will fit the lower surface 59 of a similar intersection block of the next upper course fitted thereon at right angles. Adjacent to the inner end portion 41 of each is a stretcher block 10, whose tongues 17 engage the inner end grooves 43. On the other side of the corner, another stretcher block 10 has its vertical tongues 17 engaged in the grooves of one of the side faces 54, 56 of the intersection block 40. The grooves of the other side face and outer end face are seen on the outer wall surface and may be considered to be of decorative value; however, their presence permits blocks of identical conformation to be used at both right and left corners, and linearly at intermediate portions where partition walls intersect, as hereafter described. From the corner, the wall continues in both directions with additional full-length stretcher blocks 10.

Persons skilled in the art will realize that before another corner is reached, it will be necessary to utilize a double-tongued or reversal stretcher block as described above so that the general purpose intersection block 40 utilized at the next corner may receive vertical tongues. The corner is further strengthened by vertical reinforcing rods a in the intersection block corner end portion vertical core 61, along with grout poured therein as the wall is being built.

An example of construction of a partition wall which interlocks with a forward wall is shown in FIG. 9. At the partition inward of the right side of the drawing, the lower two courses each utilize general purpose intersection blocks 40. Viewing the course shown in FIG. 10, their second side face vertical grooves 57 are mated to vertical parallel tongues 17 of partition wall stretcher blocks. These general purpose intersection blocks 40 are mounted in linear alignment with the stretcher blocks of the forward wall; hence, the tongues 17 of adjacent stretcher blocks are inserted matingly in the corner block outer end face grooves 53 at all such courses. In the course below that shown in FIG. 10, the corresponding general purpose intersection block 40 is reversed left to right, but its corner end portion 51 is directly beneath that of the overlaying course. Hence, the tongues 17 of the partition wall stretcher block at the lower of these courses will mate with the corner block opposite side face grooves.

For the third, or uppermost course of the partition, as shown in FIG. 9, a general purpose intersection block 40 extends forward from the partition wall, at a right angle to the forward wall blocks, to have its corner end portion 51 lie vertically above the corner end portion 51 of the second course intersection block 40. Its inner end portion 41 forms part of the partition wall, overlapping the full-length stretcher block 10 in its second course. The deficiency of wall length, caused by using only the width of this intersection block at the third course, is compensated for by inserting a half-block 30, whose vertical tongues engage the second side face vertical grooves 57. The full-length stretcher blocks 10 and a reversal stretcher block, as described, lead to the next corner. In this example, other courses above these three described alternately have these configurations of blocks.

Figure 10:
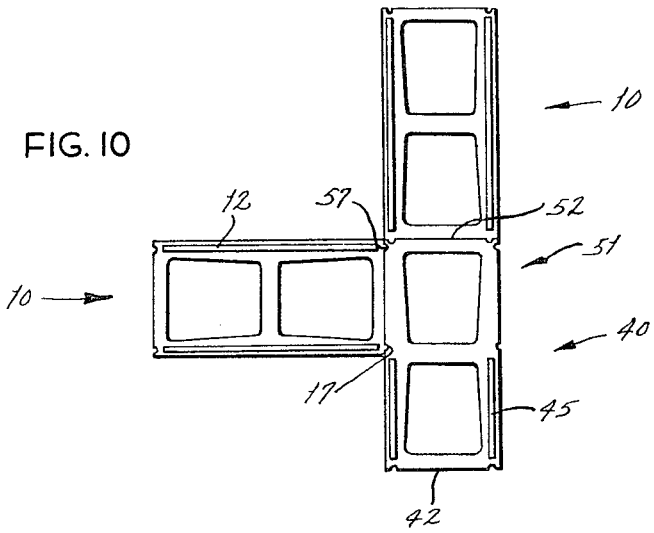
FIG. 10 is a sectional view taken along line 10—10 of FIG. 9, from above the second course, showing the intersection of the forward wall with the partition wall.

Similarly, should it be desired to have a wall cross another, the general purpose intersection blocks 40 may be used to provide, at such crossing intersections, both the interlocked connections, as at the upper part of FIG. 9, and the non-interlocked intersections shown in FIG. 10. This is made possible because these intersection blocks have vertical grooves on each of the three surfaces of their corner ends.

In construction of bond beams, bond beam intersection blocks 90 as shown in FIGS. 7 and 8, or the alternative bond beam intersection block 130 as shown in FIG. 12, are utilized at corner, partition wall and crossing-wall intersections, with bond beam channel blocks 70 forming the bond beam courses therebetween. At a corner of the uppermost course shown in FIG. 11, a bond beam intersection block 90 is positioned linearly continuing from one bond beam channel block 70 and at right angles to another, with its corner end portion 110 atop the general purpose intersection block corner end portion 51 of the course below. By breaking out the bond beam intersection block 90 between its breakout score lines 121 which extend toward its first side face 113, preferably down to the level at which the saddle 82 will support a reinforcing rod, horizontal reinforcing rods b may be laid to extend through the channel blocks on each side of the corner end to the vertical core 120 at the corner. Vertical reinforcing rods a and grout through the hollow vertical core 120 are there connected to the horizontal rods b and grout, to form an interlocking grid.

At intersections with partition walls, to tie the horizontal rods b and grout from a running forward wall into the partition wall, a bond beam intersection block is utilized, as shown near the right side of the upper course in FIG. 11. The bond beam intersection block corner end portion 110 receives in the grooves 116 of its second side face 115 the end tongues 75 of a bond beam channel block 70. By breaking away the corner end portion 110 between that portion of the side face 115 between its score lines 121 and also breaking away the score lines 121 in its outer end face 111 adjacent the linearly abutting channel block 70, horizontal reinforcing rods b there intersecting can be tied together and the grout can flow together, forming a strong link between the bond beams. Unbroken pairs of breakout score lines 121 become filled with grout and the block is then of unimpaired strength. Vertical reinforcing rods a and grout in the corner end portions of both the bond beam intersection block 90 and general purpose intersection blocks 40 complete the integral reinforced concrete grid. Should there be a crossing-wall intersection, all three scored faces of the corner end portion 110 of the bond beam intersection block 90 will be broken away so that there may be a four-way reinforced intersection.

The alternative bond beam intersection block 130 is used in a similar manner for corners and partition walls, as shown in FIG. 13. Its U-shape saddles and broken out portions may accommodate multiple side-by-side reinforcing rods, including the horizontal right angle rod 133 whose intermediate right angle bend is received and accommodated within the cored corner end 110 of the corner block 130; one of its elongated rectilinear end portions extends through the broken-away portion between the score lines 121 of the side face 115 to the adjacent bond beam channel block of the perpendicular wall. The other elongated end extends through its inner end 91 to an adjacent linearly continuing bond beam channel block 70. Conventional straight reinforcing rods b overlap the right angle rod 133; if desired they may be tied together by conventional means, though it is thought to be unnecessary.

As further shown in FIG. 12, the right angle rod 133 may be installed in a vertical plane, with one of its rectilinear end portions extending horizontally in the bond beam course and its opposite end portion extending vertically, upward or downward, either through the corner ends of the general purpose intersection blocks 40 at a wall intersection or through the cores of stretcher blocks adjacent to windows and doors. In either case, the reinforcement provides added strength where most needed, to prevent the cracking which is likely to occur with conventional construction.

If even greater strength is required where intersection blocks are utilized, the vertical cores adjacent to the intersection may be rodded and grouted, such as suggested in FIG. 12. The solid bottom of the inner end of the bond beam intersection block may be knocked out and a vertical reinforcing rod and grout installed. The bond beam intersection block may be provided with score lines or a thinned area in the inner end bottom to facilitate knocking out such a portion.

Universal intersection blocks

As an alternative embodiment of the present invention, the mortarless concrete block system may utilize universal intersection blocks at corners, partition walls, crossing-walls, or pilasters of both bond beam courses and the non-reinforced courses between them, in substitution for the general purpose blocks 40 and bond beam intersection blocks 90.

Such universal intersection block, not shown in the drawings, has a corner end portion identical with that of the bond beam intersection block 90. However, its intermediate web has score lines, extending from the corner core, similar to the score lines in the other sides of the core. Its inner end portion is also like that of a bond beam intersection block 90, its core ending in a bottom wall; but instead of having a saddle-shaped end web, it has an exteriorly unbroken surface scored for breakout.

To give the wall added strength, a surface bonding process may be utilized on both the interior and exterior surfaces of the walls. That technique, well known to persons skilled in the art, consists of applying to the surface, such as by rolling or spraying, concrete or a plaster-like material which includes reinforcing fibers, permanently bonding the blocks together.

The above disclosure describes these block conformations which the inventor believes to be the best mode for construction and utilization of the present invention, but it will be apparent that the invention may take other forms. For example, the shapes, sizes and spacings of the ridges and grooves and tongues and grooves may vary. Persons skilled in the art will realize that it is unnecessary (except for convenience in molding) to form horizontal grooves in the corner end lower surfaces of the general purpose, bond beam and universal intersection blocks, as in the above-described embodiment.

The bond beam channel blocks and bond beam intersection blocks might be made without tongue-and-groove end provisions, which merely aid in aligning the blocks; since reinforcing rods and grouting later form the blocks into a solid beam, the tongue-and-groove provisions do not add substantially to strength. The webs, which support reinforcing rods above the level of the channel bottom of the bond beam channel blocks and bond beam intersection blocks to permit grout to flow therebeneath, need not connect the sides of the channels; instead they might simply extend upward from the channel bottom a short distance, serving much the same purpose, as these channels will likewise be filled by grouting.

While it is expected that the principal use of the invention will be in the field of concrete blocks, the invention is also utilizable with other materials. For some uses, blocks may be made of redwood or other materials characterized by ease of fabrication, advantageous thermal insulating properties, desirable surface finishes and similar considerations.

The educational value to children of building with toy blocks has long been recognized. The conformations of the present general purpose intersection blocks, together with stretcher blocks, reversal blocks and half blocks, make their combination a system well suited for toy use when made of molded plastic. The corner end portions of the intersection blocks may be adapted to receive corner posts of such cross-section as to press-fit within their vertical cores, so as to secure the intersection blocks, stacked alternately at right angles, by their corner end portions. These and other modifications will, from the above disclosure, be apparent to persons skilled in the art.

I claim:

1. A wall course having first and second sections extending from each other, each section comprising a plurality of first blocks, each first block having side and end walls with one end wall provided with spaced parallel narrow vertical ribs and an opposite end wall provided with correspondingly spaced parallel narrow vertical grooves, and the wall course having an intersection block adapted to connect the first and second sections to enable them to extend at an angle to each other; the intersection block having rectangular end walls and side walls extending from top to bottom of the block, with parallel narrow vertical grooves in its rectangular end walls inwardly from the edges thereof, and in each side wall, that are spaced to receive the ribs on the first blocks, whereby the same intersection block may provide for the second wall portion to extend in line with, to the right, or to the left from the intersection block, or to all of them, and wherein the parts of the end of side walls that are not engaged by another wall section extend from top to bottom and side to side of the block, with the narrow grooves exposed.

2. In the wall of claim 1, the block having an inner portion and an outer portion; the outer portion having the parallel grooves in its side and end walls, and a bottom wall across at least one of the portions.

3. In the wall of claim 1, the block having weakening lines in its side walls to enable portions thereof to be knocked out to provide passages in said walls to admit reinforcing rods or the like.

4. A wall including a plurality of block courses of claim 1: one course on top of another to make a wall of two intersection sections; at least one of the said courses being a bond beam course wherein the adjacent walls of the several blocks all have means providing recesses extending down from their top edges to make saddles to receive reinforcing rods, and having metal reinforcing rods in said saddles extending horizontally along both portions of the wall, the blocks having bottom walls, grout or like material in the blocks engaging the rods; the saddles being sufficiently above the bottoms of the blocks and below the top to enable the grout to surround the blocks, the intersection blocks having means to provide openings in the bottom thereof, vertical reinforcing rods extending through a plurality of courses, and bent into said saddles, to extend horizontally, whereby with the course having horizontal rods, the vertical rods form a reinforcing frame for the wall.

5. A building block having a top, a bottom wall, side walls, end walls at the ends of the side walls, and a transverse wall between the end walls; the block having an opening extending downwardly from the top to the bottom wall between an end wall and the transverse wall; the transverse wall and the said one end wall having means therein providing saddles to extend downwardly from the top edges thereof to receive and support reinforcing rods, the other end wall being normally without any saddle, whereby to present a finished face to a wall; the opening of the block being adapted to receive and hold grout or the like confined by the bottom, side, end and transverse walls; the saddles being of an elevation to support rods above the bottom wall and below the top so that the rods may be surrounded by the grout, and the end wall saddle being of a size to enable grout in its block to unite with grout in an adjacent block, the top wall being provided at its outer edges with ridges and the bottom wall being provided at its outer edges with grooves of the spacing of the said ridges, to enable the blocks to be securely disposed one on top of another.

6. A rectangular masonry block having an inner half portion and an outer corner half portion each half being substantially square, the block having opposite side walls, one end wall for the inner half and one essentially flat end wall for the outer half portion, a web spanning between the side walls and separating the inner and outer half portions, the web having a recess extending down from its upper edge, to provide a saddle to receive horizontal reinforcing rods, the recess being deep enough to enable the rods to be completely surrounded by grout, the inner half portion having an open top and bottom wall closing its bottom to provide a receptacle for holding grout;

the outer portion having an open top and an open bottom, to receive vertical rods;

the saddles enabling the block to receive a vertical rod in the outer portion that has a horizontal part extending into the inner portion by way of the saddle in the web;

the outside surfaces of both outer portion side walls, and the two end walls having, near, but spaced from, their edges, narrow vertical grooves adapted to receive correspondingly spaced narrow tongues of an adjacent block;

the top edges of the inner portion of the block having narrow ridges extending upwardly adjacent their outer edges, the edges of the outer portion being free of such ridges;

the bottom of the block in both portions having grooves adjacent its side edges, spaced apart the same as the ridges on the top edges, pairs of knock-out scores on the inside of the outer section side and end walls, extending down from the top edges to points above the bottoms of the walls to provide for optionally making saddles therein, the blocks, when at a corner turning either to right or to left, presenting exposed surfaces having narrow, outside grooves that are relatively inconspicuous.

7. The block of claim 6 wherein pairs of knock-out scores on the inside of the outer section side and end walls, extending down from the top edges to points above the bottoms of the walls to provide for optionally making saddles therein.

8. The block of claim 6 wherein the inner end wall also has a recess extending down from its upper edges, to provide a saddle to receive horizontal reinforcing rods, the recess being deep enough to enable the rods to be completely surrounded by the grout.

9. In a masonry wall, a plurality of superposed courses of rectangular blocks, the wall having a first branch, and a second branch at right angles to the first branch; each branch of each course incorporating a first type block having side walls and end walls and being about twice as long as it is wide, one of its end walls having two narrow vertical tongues, each one near but spaced from its side edge, and its other end having two narrow grooves, also each one near but spaced from a side edge, and each spaced and sized to receive the tongues of an adjacent block; each course having at its intersection between its branches a second type rectangular masonry block having an inner half portion and an outer corner half portion each half being substantially square, the block having opposite side walls, one end wall for the inner half and one essentially flat end wall for the outer half portion, a web spanning between the side walls and separating the inner and outer half portions, the web having a recess extending down from its upper edge, to provide a saddle to receive horizontal reinforcing rods, the recess being deep enough to enable the rods to be completely surrounded by grout, the inner half portion having an open top and bottom wall closing its bottom to provide a receptacle for holding grout; the outer portion having an open top and an open bottom, to receive vertical rods; the saddle enabling the block to receive a vertical rod in the outer portion that has a horizontal part extending into the inner portion by way of the saddle in the web; the outside surfaces of both outer portion side walls, and the two end walls having narrow vertical grooves near, but spaced from, their edges, the front type block having its correspondingly spaced narrow tongues engaged in the said vertical groove of the second type block; the top edges of the inner portion of the block having narrow ridges extending upwardly adjacent their outer edges, the edges of the outer portion being free of such ridges; the bottom of the block in both portions having grooves adjacent its side edges, spaced apart the same as the ridges on the top edges, the blocks, when at a corner turning either to right or to left, permitting exposed surfaces having narrow, outside grooves that are relatively inconspicuous, the vertical grooves on the second type block receiving the tongues of a first type block; the unridged tops of the second blocks enabling the second type block of one course being disposed to extend in one branch, and the second type block of the superposed course being disposed to extend in the other branch, a reinforcing rod rising vertically through the openings at the outer end of the superposed second type blocks, and being bent to extend horizontally across the upper one of the said second type blocks; and grout in the receptacle thereof covering the rod.

10. The wall of claim 9 wherein the inner end wall also has a recess extending down from its upper edges, to provide a saddle to receive horizontal reinforcing rods, and the rods extend horizontally therethrough and into the first type block, the recess being deep enough to enable the rods to be completely surrounded by the grout.

11. A wall of inter-locking rectangular blocks of an established depth, comprising at least two courses, one on top of the other, (A) full-length stretcher blocks having a pair of parallel vertical tongues at one of their ends and having at their opposite end a pair of vertical grooves at said tongue spacing, further having a pair of parallel horizontal ridges formed on their upper surfaces and a pair of parallel grooves on their lower surfaces whose spacing equals said ridge spacing, (B) shortened stretcher blocks whose length is substantially equal to the difference between the length of said stretcher blocks and the width of said stretcher blocks, said shortened blocks having a pair of parallel vertical tongues at one of their ends and having at their opposite ends a pair of vertical grooves at said tongue spacing, further having a pair of parallel horizontal ridges formed on their upper surfaces and a pair of parallel grooves on their lower surfaces, both at a spacing equal to said ridge spacing, and (C) general purpose intersection blocks of such established depth, each comprised of two portions, namely (i) an inner end portion having an inner end face and a pair of parallel grooves formed therein at said tongue spacing, further having a pair of parallel ridges formed on its upper surface at said ridge spacing and a pair of parallel grooves formed into its lower surface at the same spacing, and (ii) a corner end portion having an outer face and two opposite side faces and having upper and lower surfaces continuous with the upper and lower surfaces of said inner end portion, the upper surface of said corner end portion being without ridges and each of said two opposite side faces and said outer end face having formed therein a pair of grooves at said tongue spacing, the courses being superposed, so that the upper surface without ridges of the corner end portion of each intersection block accommodates the lower surface of the corner end portion of a similar intersection block of the next upper course positioned at right angles thereon, and the tongues of said stretcher blocks of a course are matingly inserted in the grooves of either or both of said opposite side faces and receive the tongues of said stretcher blocks in linear alignment therewith, thereby permitting intersection blocks of identical conformation to be used as both left and right corners and to provide both T-shaped and crossing-wall intersections.

12. For use as an educational toy, the system of interlocking rectangular blocks as defined in claim 10, wherein the rectangular blocks are of molded plastic, and wherein the corner end portions of said general purpose intersection blocks each have a hollow vertical core, in combination with corner posts of such cross-section as to press-fit within the cores of said intersection blocks, whereby on construction of a wall intersection said intersection blocks of alternate courses will be secured by said corner posts at right angles to each other.

13. For use in courses in a system using concrete rectangular blocks of an established depth, at least one generally I-shaped rectangular intersection block of such established depth, having side walls, an inner end wall, and an outer end wall, a bottom wall, and a transverse wall between its ends, the inner end wall having pairs of narrow vertical grooves, the transverse wall dividing the block into an inner end portion and an outer corner end portion, the two portions being of at least substantially equal length and width, the inner end portion having a channel hollow extending down between its side, end and transverse walls, to the bottom wall to provide a four-sided grout receiving compartment; the outer corner end portion having a vertical recess extending down from the top; spaced narrow vertical ribs along the lateral edges of the top of the inner portion, beside the channel hollow, the top of the outer end portion being free of such ribs; pairs of spaced narrow vertical grooves at the edges at the end wall of the corner portion, and equally spaced narrow grooves vertically disposed on each side of the corner portion, the grooves being thus capable of mating with equally spaced ribs on connecting blocks at the end or on either side, the the arrangement permitting the block to interfit on either side or either end with ribbed blocks, the grooves being small so that if exposed in a wall they are not excessively conspicuous.

14. The block of claim 13, wherein the recess in the outer corner portion extends vertically through the block.

15. Bond beam intersection blocks as defined in claim 14, reinforcing rod members, each having a substantially right-angle intermediate bend and rectilinear elongated portions extending therefrom in the same plane, said intermediate bend being accommodated within the corner end portion of an intersection block with one of its rectilinear portions extending horizontally in the bond beam course and its other rectilinear portion extending vertically through the hollow vertical openings of itself and those of vertically adjacent blocks.

16. Bond beam intersection blocks as defined in claim 13, wherein said corner end portion vertical walls have pairs of parallel vertical breakout score lines on the inner surfaces of both said side walls extending downward from the upper surface of said corner end portion between the narrow vertical grooves therein, ending upward of the lower surface of the corner end portion, whereby to permit the block side faces to be broken out between said breakout score lines for receiving and supporting, above the level of the lower surface of the block, the horizontal rodding from such adjacent channel blocks at right angles thereto.

17. Bond beam intersection blocks as defined in claim 16, wherein the end wall of said corner end portion vertical wall further has a pair of similar parallel vertical breakout score lines on the inside surface, whereby to permit linearly continuous rodding and grouting at both T-shaped and crossing-wall intersections.

18. Bond beam intersection blocks as defined in claim 13, wherein at least one side face of said corner end portion vertical wall has a pair of parallel vertical breakout score lines on its inside surface extending downward from the upper surface of said corner end portion, ending upward of the lower surface of the corner end portion, in combination with reinforcing rod members each having a substantially right-angle intermediate bend and rectilinear elongated portions extending therefrom in the same plane, thereby to permit passage to an adjacent channel block of one of said rectilinear portions while the right-angle bend is accommodated within said corner end portion of said intersection block and the other rectilinear portion extends through the inner end channel hollow of said intersection block to a channel block thereadjacent.

19. The bond beam intersection block as defined in claim 18, wherein both side faces of said corner end portion vertical wall have a pair of similar parallel vertical breakout score lines, whereby the outer end face may be broken away to so receive said right-angle reinforcing members at both T-shaped and crossing-wall intersections.

* * * * *